US007392801B2

(12) United States Patent
McCallister et al.

(10) Patent No.: US 7,392,801 B2
(45) Date of Patent: Jul. 1, 2008

(54) BALL PITCHING MACHINE

(76) Inventors: Mitchell McCallister, 931 Trinity Dr., Newton, KS (US) 67114; Marcus Kosjer, 6103 - 12th , Douglass, KS (US) 67039

( * ) Notice: Subject to any disclaimer, the term of this patent is extended or adjusted under 35 U.S.C. 154(b) by 0 days.

(21) Appl. No.: 11/120,728

(22) Filed: May 3, 2005

(65) Prior Publication Data

US 2007/0144505 A1 Jun. 28, 2007

(51) Int. Cl.
*F41B 3/00* (2006.01)

(52) U.S. Cl. ..... 124/17; 124/35.1

(58) Field of Classification Search ..... 124/16, 124/17, 35.1

See application file for complete search history.

(56) References Cited

U.S. PATENT DOCUMENTS 2,501,568 A * 3/1950 Jarnagin ..... 124/20.1
3,277,878 A * 10/1966 Pankratz ..... 124/20.1
5,431,145 A * 7/1995 Strait et al. ..... 124/17
5,657,984 A * 8/1997 Leo ..... 124/20.1
5,694,913 A * 12/1997 Parrott ..... 124/17

* cited by examiner

*Primary Examiner*—John Ricci
(74) *Attorney, Agent, or Firm*—Kenneth H. Jack; Davis & Jack, L.L.C.

(57) ABSTRACT

A ball pitching machine having a first "U" bracket having front and rear arms, the first "U" bracket further having rocker beam base spanning between the front and rear arms; a second "U" bracket having left and right arms, each left and right arm having a distal end, the first "U" bracket's front arm comprising the second "U" bracket; a third "U" bracket having left and right arms, the third "U" bracket having sling pinching pivot arms adapted for moving the left and right arms between sling pinching and sling releasing positions; left and right elastomeric ties, each having proximal and distal ends, the proximal ends of the left and right elastomeric ties being respectively fixedly attached to the distal ends of the second "U" bracket's left and right arms; a sling having left and right ends, the distal ends of the left and right elastomeric ties being respectively fixedly attached to the sling's left and rights ends; and a trajectory adjusting carriage fixedly attached to and supporting the first "U" bracket.

13 Claims, 6 Drawing Sheets

BALL PITCHING MACHINE

FIELD OF THE INVENTION

This invention relates to projectile hurling or pitching apparatus. More particularly, this invention relates to such apparatus which are specially adapted for hurling or pitching balls, particularly baseballs, softballs, and the like.

BACKGROUND OF THE INVENTION

Electric motor powered baseball and softball pitching machines are known. In one such known machine, baseballs or softballs are successively mechanically fed into a pinch point gap established between counter-rotating friction wheels. Such wheels simultaneously frictionally engage a baseball, forcefully expelling the ball toward a batting practice strike zone. In another example of such machines, the electric motor drives an air blower for pressuring a valued compressed air chamber of a pneumatic ball cannon. In another example, the electric motor powers a ball pitching swing arm. All of such known ball pitching machines undesirably require the provision of electrical power, either via a storage battery, or an extension cord. Also, all of such known ball pitching machines are undesirably heavy, bulky, and are unwieldy. Also, such known electric motor powered ball pitching machines are typically incapable of providing consistent and repeated ball placement, ball speed, and ball spin, while providing for selective variability of such ball trajectory characteristics. Also, such known electric powered ball pitching machines typically undesirably fail to preliminarily visually display the ball prior to a pitch.

The instant inventive ball pitching machine solves or ameliorates all of the problems discussed above, while additionally effectively performing all of the desirable functions described above by providing an elastic band actuated device which functions in combination with a specialized mechanical ball releasing mechanism, and which functions in further combination with a specialized trajectory aiming mechanism.

BRIEF SUMMARY OF THE INVENTION

The instant inventive ball pitching machine preferably comprises a first longitudinally oriented "U" bracket having a lower base beam or rocker beam, having an upwardly extending front arm, and having an upwardly extending rear arm, the lower base or rocker beam spanning between and rigidly interconnecting the front and rear arms. The upwardly extending front arm of the preferred first "U" bracket is preferably configured to comprise a second "U" bracket, configured similarly with a "Y" of a sling shot, the second "U" bracket having left and right upwardly extending arms, each such arm having an upper distal end.

The rear arm component of the preferred first "U" bracket is preferably configured to comprise a third "U" bracket, such bracket having left and right upwardly extending sling and ball pinching arms. The third "U" bracket preferably further comprises sling pinching means. Preferably, the sling pinching means is mechanically capable of moving the third "U" bracket's sling and ball pinching arms between inwardly retracted sling and ball pinching positions and outwardly splayed sling and ball releasing position. In a preferred embodiment, such sling pinching means comprises a combination of a crossbeam, left and right forwardly extending pivot arms, and pivotal mounting means interconnecting proximal ends of the left and right forwardly extending pivot arms with the crossbeam. In such preferred embodiments, the crossbeam serves as a girdle which pivotally interconnects the proximal ends of the pivot arms.

The left and right upwardly extending sling pinching arms of the third "U" bracket are preferably respectively fixedly attached to the preferred distal ends of the left and right pivot arms. Pivot arm biasing means are preferably provided, such means being connected operatively to the left and right pivot arms for normally moving such arms and their connected left and right sling pinching arms to their outwardly splayed sling and ball releasing positions. In a preferred configuration of the instant invention, the pivot arm biasing means comprises leftward and rightward extensions of crossbar girdle, such extensions advantageously facilitating left and right triangulating attachments of left and right pivot arm splaying springs.

The sling and ball pinching means preferably further comprises a trip bracket which is fitted for alternate nesting engagement with and disengagement from the left and right pivot arms. Upon engagement of the trip bracket with the left and right pivot arms, the trip bracket advantageously simultaneously holds both of the pivot arms and their attached left and right sling pinching arms at their inwardly retracted sling and ball pinching and retaining positions. Upon alternate disengagement of the trip bracket from the left and right pivot arms, such arms and the left and right sling pinching arms are freed for outwardly splaying sling and ball releasing motions. Where the preferred pivot arm biasing means is provided as described above, such means swiftly moves such arms to their sling and ball releasing splayed positions, such motion advantageously providing for "clean" ball releases.

In a preferred configuration of the instant invention, and assuming that a pivot arm engaging trip bracket is provided as described above, such trip bracket is preferably configured as a fourth "U" bracket having left and right downwardly extending pivot arm engaging arms. Also, where such preferred trip bracket is provided, the sling pinching means component of the third "U" bracket preferably further comprises a rocker arm having a forwardly extending trip end, and having a rearwardly extending handle end, the rocker arm preferably being pivotally mounted upon the crossbeam. The pivotal mount of the preferred rocker arm is preferably arranged for facilitation of movement of the rocker arm between first and second positions, the trip end of the rocker arm moving the attached trip bracket into engagement with the left and right pivot arms upon pivotal motion of the rocker arm to the first position, the rocker arm disengaging the trip bracket upon pivotal motion to the second position. Rocker arm biasing means operatively connected to the rocker arm are preferably provided, such means normally moving the rocker arm to its first pivot arm engaging position. Preferably, such biasing means comprises a spring which triangulatingly spans between the trip bracket and an underlying anchor point upon the first "U" bracket's rear arm.

Left and right elastomeric ties, preferably composed of heavy gauge latex rubber tubing, are preferably provided, each such tie having proximal and distal ends. The proximal ends of the left and right elastomeric ties are preferably respectively fixedly attached to the distal ends of the second "U" bracket's left and right upwardly extending arms. A flexible sling is also preferably provided, such sling having left and right ends. The distal ends of the preferred left and right elastomeric ties are preferably respectively fixedly attached to the left and right ends of the sling.

In use of the instant inventive ball pitching machine, and assuming the provision of preferred features as described above, a baseball or softball may be placed within the sling. Thereafter, the baseball and the sling combination may be simultaneously drawn manually rearwardly toward the third "U" bracket's sling pinching arms. Preferably, the sling pinching arms have been preliminarily inwardly drawn to their retracted sling pinching positions, and preferably the rocker arm has been preliminarily moved to its first position, engaging the trip bracket for holding the pivot arms. The manual rearward stretching of the elastomeric ties preferably continues until the ball and sling combination overlies the sling pinching arms. Thereafter, the ball and sling combination may be moved downwardly between the sling pinching arms. Thereafter, the manual rearward pulling force applied to the ball and sling combination may terminate, allowing the left and right elastomeric ties to forwardly pull the ball and sling combination against the sling pinching arms.

The diameter of the ball is necessarily greater than the retracted position displacement of the left and right sling pinching arms, such dimensional relationship advantageously allowing forwardly directed pulling forces applied by the elastomeric ties to the sling and ball combination to drive the left and right pivot arms against left and right pivot stopping surfaces of the engaged trip bracket while such arms stop any forward motion of the ball and sling combination. Upon subsequent pivotal movement of the rocker arm to its second position, the trip end of the rocker arm disengagingly moves the trip bracket, allowing the left and right pivot arms and sling pinching arms to laterally splay, and allowing left and right elastomeric ties to forwardly hurl or pitch the sling and baseball between the left and right arms of the second "U" bracket.

Where the preferred sling pinching arms and sling pinching means combination is provided in further combination with left and right elastomeric straps and a sling, all as described above, the instant inventive ball pitching machine preferably further comprises means for forwardly stretching the left and right elastomeric straps. The aforedescribed framework of "U" brackets constitutes a preferred elastomeric tie stretching and extending means, such framework advantageously supporting the elastomeric ties in a manner common to a sling shot. Numerous other mechanical structures capable of forwardly stretching the left and right elastomeric ties are considered to fall within the scope of the invention.

Assuming that the tie stretching means component of the instant invention comprises the preferred "U" bracket frame combination as described above, the base or longitudinally extending element of the first "U" bracket preferably incorporates telescoping means allowing such base to be alternately shortened and lengthened, and allowing the longitudinal displacement of the second and third "U" brackets to be correspondingly selectively decreased and increased. The amount of stretch of the left and right elastomeric ties may thereby be advantageously adjusted, resulting in selective adjustability of ball pitching speed. Such telescoping means preferably comprises segmentation of such base beam, and such means preferably further comprises at least a first segment receiving slide sleeve, the segments and the slide sleeve forming at least a first slide shaft and slide sleeve joint. Set screws are preferably provided for releasably securing such joint.

The instant inventive ball pitching means preferably further comprises a carriage which is preferably mechanically adapted for adjusting the trajectory of balls pitched. The carriage element preferably comprises an "L" frame which includes a vertical support column having an upper end, and includes a base beam extending rearwardly from a lower end of the vertical support column. Where the preferred "U" bracket's frame configuration is provided, the first "U" bracket's base beam or rocker beam is preferably pivotally attached to the upper end of the "L" frame's vertical support column, such pivotal attachment advantageously facilitating trajectory adjusting pivoting motion of the rocker beam with respect to the support carriage. Where such pivoting motion is mechanically facilitated, means for stopping such pivoting motion at a selected trajectory angle are preferably further provided. Such means preferably comprises a slide shaft and slide sleeve combination which is mounted upon the carriage so that it spans between the first "U" bracket's rocker beam and a point upon the "L" frame rearward of the support column. Such slide shaft and slide sleeve combination is preferably pivotally mounted at its upper and lower ends, allowing alternate extensions and retractions of the slide sleeve and slide shaft combination to alternately pivot and counter-pivot the first "U" bracket about its pivotal attachment with the "L" frame's vertical support column.

In order to enhance the stability of the instant inventive ball pitching machine while the machine rests upon baseball diamond ground surfaces, front and rear "T" feet are preferably provided, the rear "T" foot preferably being fixedly attached to the rear end of the "L" bracket. Suitably, the front "T" foot may be fixedly attached to the lower front end of the "L" bracket. However, for purposes of enhanced adjustability of ball trajectory, means for alternately downwardly extending and upwardly retracting the front "T" foot are preferably provided. Such means preferably comprises a slide sleeve fixedly attached to the "L" frame's vertical support column, and a vertically extending slide shaft extending through such slide sleeve, the front "T" foot being fixedly attached to a lower end of the slide shaft. By retracting and shortening the above described rocker beam angle adjusting slide shaft and slide sleeve combination, and by simultaneously downwardly extending the front "T" foot in the manner described above, the trajectory angle of the first "U" bracket with respect to the "L" frame may be increased, and the angular orientation of the "L" frame, with respect to the ground, may be simultaneously increased. Such dual angular adjustment capability advantageously provides for trajectory adjustments suitable for both pitching balls for batting practice and for pop fly fielding practice.

Accordingly, objects of the instant invention include the provision of a ball pitching machine which incorporates elements of structure described and discussed above and which arranges those elements of structure in manners facilitating the performance of functions as discussed above.

Other and further objects, benefits, and advantages of the instant inventive ball pitching machine will become known to those skilled in the art upon review of the Detailed Description which follows, and upon review of the appended drawings.

DETAILED DESCRIPTION OF A PREFERRED EMBODIMENT

Figure 1:
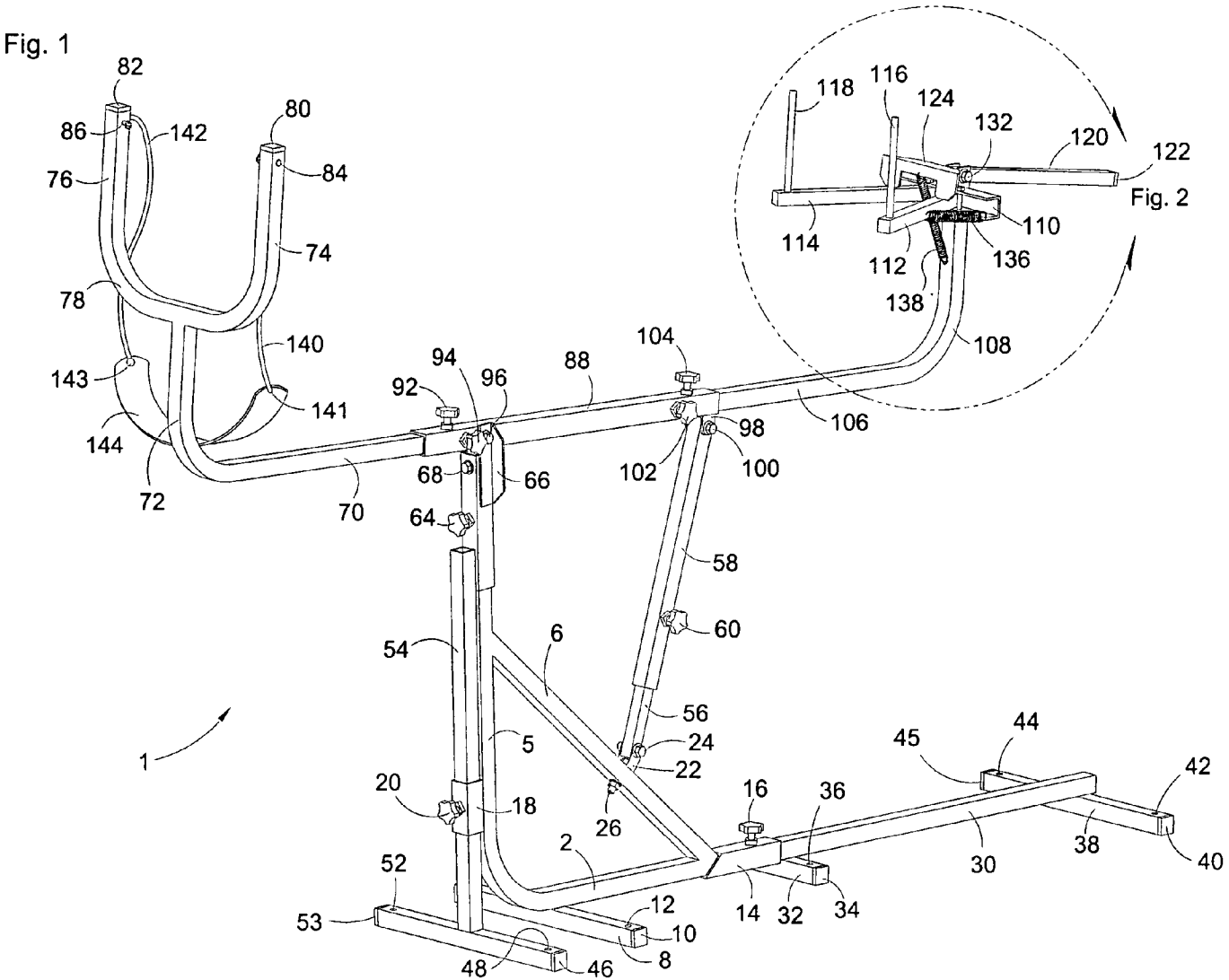
FIG. 1 is an isometric view of a preferred embodiment of the instant inventive ball pitching machine.

Referring now to the drawings, and in particular to FIG. 1, the instant inventive ball pitching machine is referred to generally by Reference Arrow 1. The ball pitching machine preferably comprises a support carriage which preferably comprises a rigid "L" frame having a base beam 2 and a vertical support column 5. The base beam 2, and the vertical support column 5 are preferably wholly formed of a single length of steel square tubing. For purposes of enhanced rigidity of "L" frame carriage, a triangulating brace 6 preferably spans between the vertical support column 5 and the base beam 2.

Figure 6:
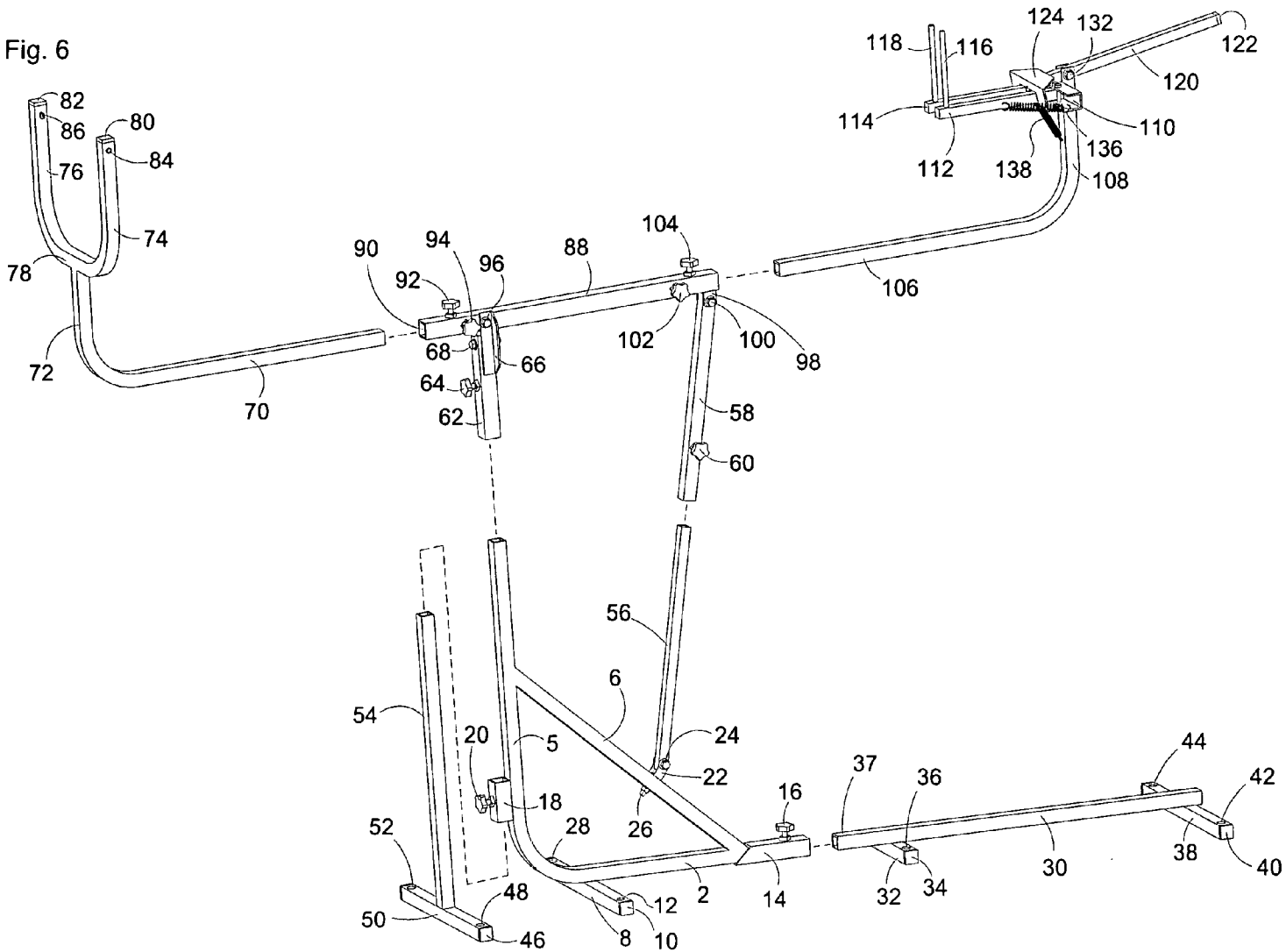
FIG. 6 is an exploded view of the machine of FIG. 1.

Referring simultaneously to FIGS. 1 and 6, the base beam 2 is preferably longitudinally segmented to include a rearwardly extending segment 30. A slide sleeve or socket 14 is preferably welded integrally with the base beam 2, such slide sleeve 14 being fitted for nesting receipt of the forward end 37 of the rearwardly extending segment 30. Upon forward insertion of the forward end 37 of section 30 into the bore of slide sleeve 14, a set screw 16 may be manually turned to engage and hold such forward end 37, such engagement securely configuring the base beam 2 as depicted in FIG. 1. Alternate threaded retraction of set screw 16 advantageously allows rearward withdrawal and disassembly of segment 30 for convenient and compact storage.

Referring further to FIGS. 1 and 6, "T" feet 32 and 38 are preferably fixedly welded to segment 30, the open ends of "T" feet 32 and 38 preferably being covered by plastic end caps 34, 40, 44, and 45. A forward "T" foot 8 is similarly fixedly welded to the undersurface of the forward end of the base beam 2, such "T" foot 8 similarly having end covering caps 10.

Figure 5:
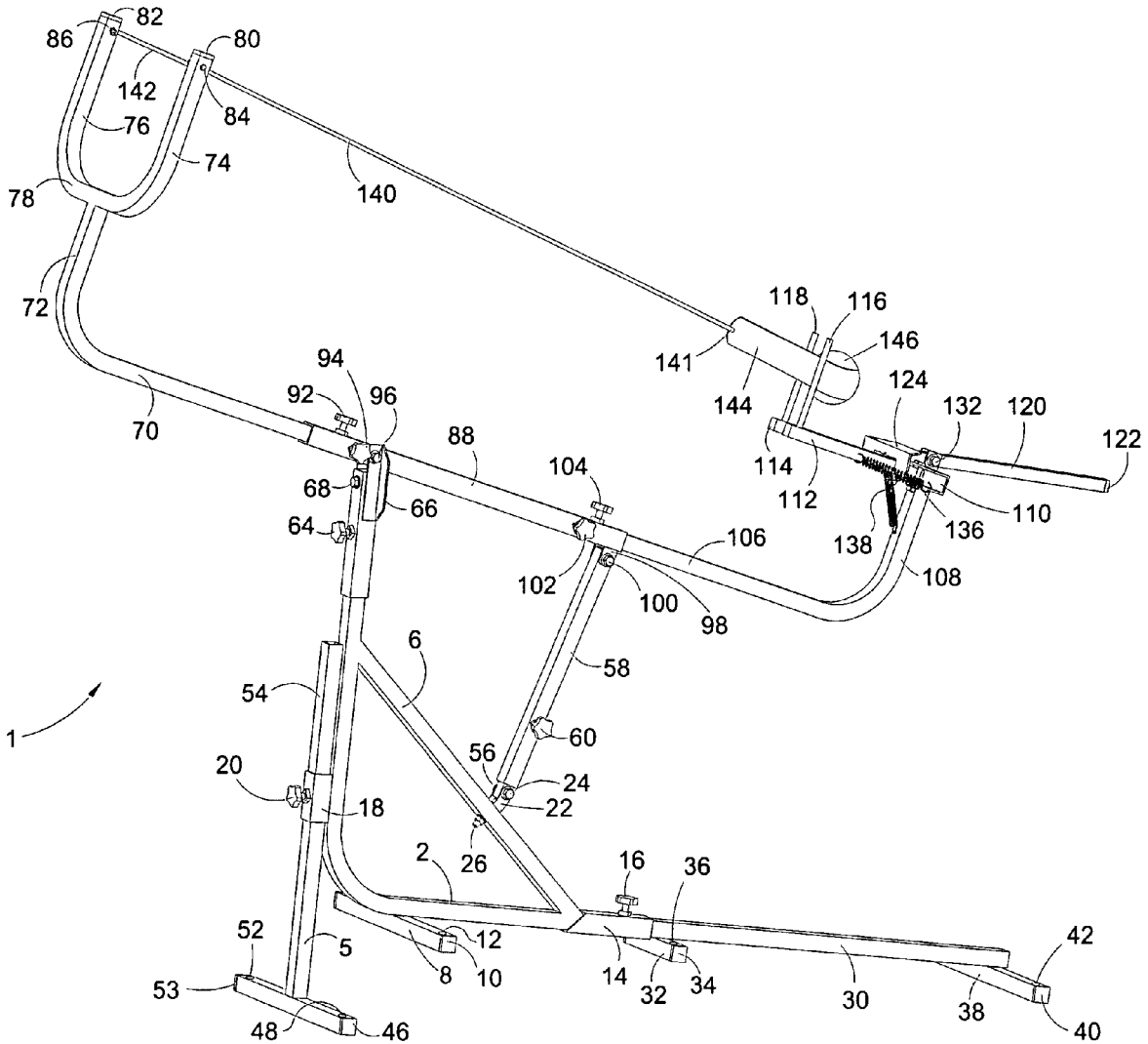
FIG. 5 redepicts the machine of FIG. 3, the view showing a configuration facilitating elevated trajectory.

Referring further simultaneously to FIGS. 1 and 6, a further forward "T" foot 50 is preferably provided, such "T" foot 50 preferably having welded thereto an upwardly extending slide shaft 54. Like "T" feet 8, 32, and 38, the lateral ends of "T" foot 50 are preferably covered by end caps 46 and 53. A slide sleeve 18 is preferably fixedly welded to the forward surface of the vertical support column 5, the slide sleeve 18 slidably receiving the slide shaft 54. Referring further simultaneously to FIG. 5, set screw 20 which threadedly extends through slide sleeve 18 may be manually threadedly withdrawn for releasing slide shaft 54 for downward sliding motion. Upon such release, the "L" frame may be conveniently displaced from the horizontal ball pitching orientation depicted in FIG. 1 to the upwardly angled orientation depicted in FIG. 5, such upward angle facilitating gross ball trajectory adjustment for pop fly fielding practice. Preferably, the lateral ends of "T" feet 50, 8, 32, and 38 include vertically extending stake receiving apertures 48, 52, 12, 36, 42, and 44, such apertures allowing the ball pitching machine 1 to be conveniently and securely staked via ground stakes (not depicted) onto a ball diamond ground surface (not depicted).

Referring simultaneously to FIGS. 1 and 6, a removable slide sleeve or socket 62 is preferably provided, such sleeve 62 preferably being fitted for nesting and sliding receipt of the upper end of the vertical support column 5. A bolt 68 preferably extends laterally through the bore of slide sleeve 65, such bolt 68 serving as a slide stop which fixes the vertical positioning of slide sleeve 65 upon the vertical support column 5. A set screw 64 which threadedly extends through the wall of slide sleeve 62 is preferably provided, the set screw 64 releasably securing the slide sleeve 62 upon the upper end of the vertical support column 5. A clevis pivot mount 66 is preferably fixedly welded to the upper end of slide sleeve 62.

Referring further simultaneously to FIGS. 1 and 6, a second trajectory elevation adjusting means or fine elevation adjustment, preferably in the form of a telescoping and slide shaft and slide sleeve combination is provided, such combination preferably including a slide sleeve 58 and a slide shaft 56. A pivot mount clevis 22 is preferably fixedly attached to brace 6 by a threaded nut and bolt combination 26, such clevis 22 pivotally receiving the lower end of slide shaft 56, such lower end being pivotally secured thereon by means of a bolt 24 which extends laterally through the left and right ears of clevis 22 and through the lower end of slide shaft 56. A set screw 60 which extends threadedly through the wall of slide sleeve 58 is preferably provided, the set screw 60 being alternately engagable with and disengagable from slide shaft 56 for selective fine adjustment of the position of slide sleeve 58 upon slide shaft 56. The slide sleeves 18 and 58, in combination with their received slide shafts 54 and 56 constitute dual fine and gross trajectory elevation adjusting means. Triple elevation adjusting means may be achieved by utilizing set screw 68 for variably positioning the slide sleeve or socket 62 upon the upper end of the vertical support column 5.

Referring further simultaneously to FIGS. 1 and 5, the entire underlying structure including feet 50, 8, 32, and 38, the base beam 2, the vertical support column 5, brace 6, and slide shaft and slide sleeve combinations 54, 18, 56, and 58 constitutes a carriage for supporting a first "U" bracket. Such first "U" bracket preferably includes a base beam or rocker beam 88, which includes and comprises a front arm 72, and a rear arm 108. The base or rocker beam 88 is preferably longitudinally segmented to include at least the rearward segment 106, and for purposes of compact disassembly, the forward segment 70. Preferably, the medial section 88 of the base beam 88 comprises a length of steel square tubing having a bore fitted for sliding receipts of the rearward end of the forward segment 70 and the forward end of the rearward segment 016. The base or rocker beam 70, 88, 106 is preferably dually pivotally mounted upon the upper ends of slide sleeves 62 and 58 by means of a laterally extending bolt 96 which extends through the ears of the clevis 66 and thence through beam 88, and by further means of a bolt 100 which extends laterally through the ears of a pivot mount clevis 98 and thence through the upper end of slide sleeve 58. Upon manual manipulation of the slide sleeve 58 and slide shaft 56 telescoping means, the angular orientation and trajectory of beam 88 with respect to the underlying the "L" frame may be finely adjusted.

Referring further simultaneously to FIGS. 1 and 6, the bolt 96 which extends laterally through clevis 66 and through beam 88 conveniently dually serves as a slide stop for limiting rearward insertions of the rearward end of the forward segment 70 into the bore 90 of the medial section 88. A vertically extending set screw 92 and a laterally extending set screw 94 are preferably provided, such set screws being advantageously alternately engagable with and disengagable from upper and side walls of the forward segment 70 for securing the forward segment in the position depicted in FIG. 1, and for alternately releasing such forward segment for compact disassembly and storage.

Referring further simultaneously to FIGS. 1 and 6, set screws 102 and 104 extending laterally and vertically through the side and upper walls of the medial section 88 are preferably provided, such set screws 102 and 104 being alternately engagable with and disengagable from the rearward segment 106. Through manipulation of set screws 102 and 104, and through longitudinal sliding positioning of rearward segment 106 with respect to the medial segment 88, the longitudinal distance between the first "U" bracket's front arm 72 and rear arm 108 may be advantageously adjusted for adjusting ball pitching speed, as will be further explained below.

The front arm 72 of the first "U" bracket preferably is configured to comprise a second "U" bracket having left and right arms 74 and 76, and having a laterally extending base 78 which spans between and interconnects the lower ends of the left and right arms 74 and 76. Preferably, the arms 74 and 76 and the base 78 are wholly formed of a single length of square steel tubing. Elastomeric ties 140 and 142 are preferably provided, such ties preferably comprising lengths of heavy gauge latex rubber tubing. Proximal ends of ties 140 and 142 are preferably fixedly secured to the upper or distal ends of the left and right arms 74 and 76 of the second "U" bracket by means of fasteners 84 and 86. A flexible ball carrying sling 144 is preferably provided, such sling 144 having left and right ends 141 and 143, at which points the distal ends of elastomeric ties 140 and 142 are preferably fixedly attached. The upper or distal ends of the second "U" bracket's left and right arms 74 and 76 are preferably covered by plastic caps 80 and 82.

Figure 2:
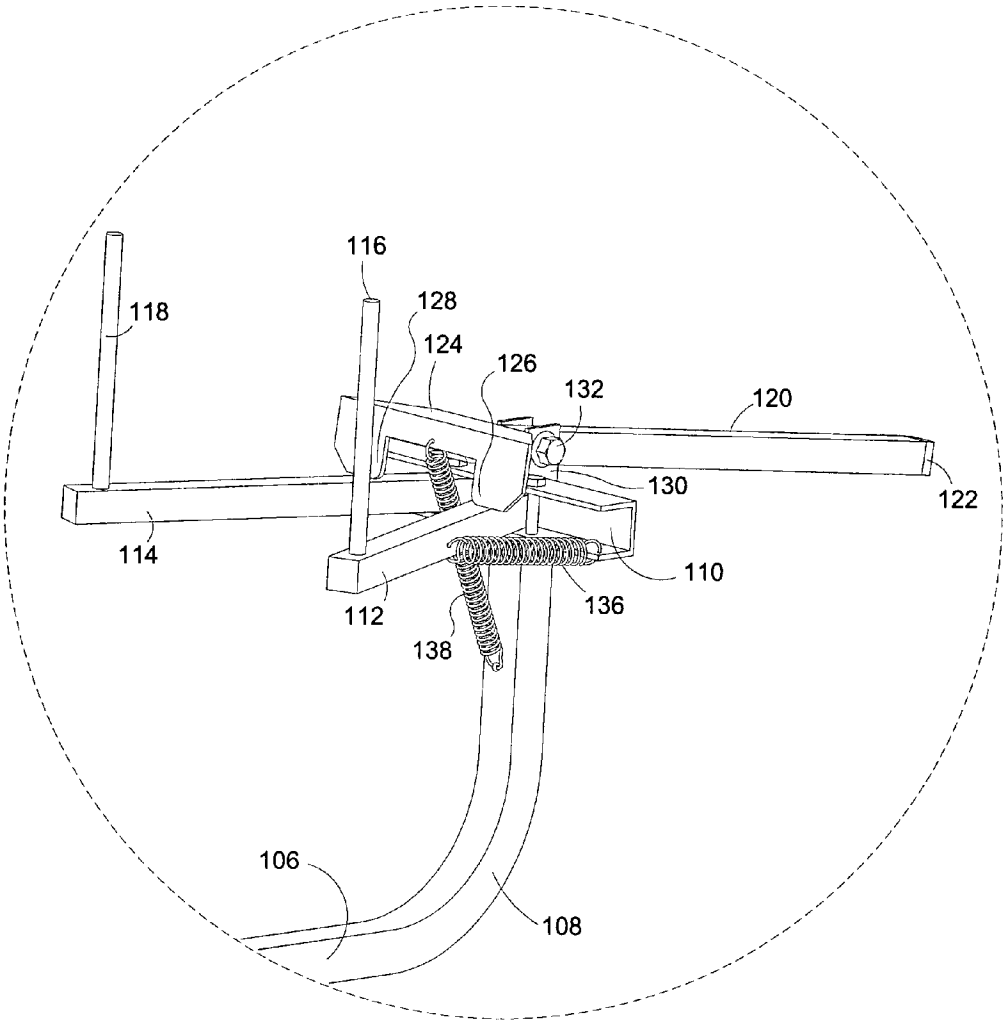
FIG. 2 is a magnified detail of a portion of the machine of FIG. 1, as indicated in FIG. 1.
Figure 4:
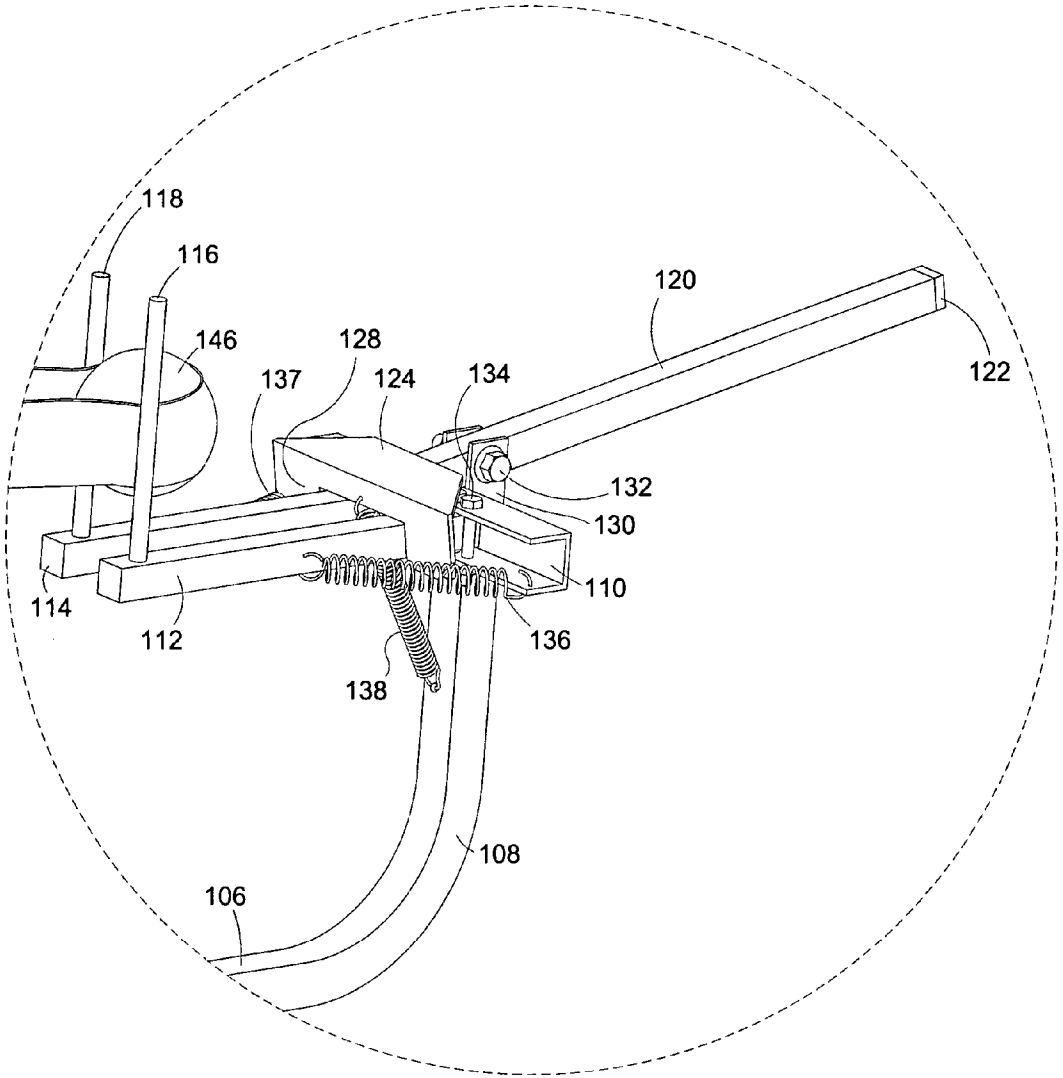
FIG. 4 is a magnified detail of a portion of the machine of FIG. 3, as indicated in FIG. 3.

Referring simultaneously to FIGS. 1, 2, and 4, the rear arm 108 of the first longitudinally extending "U" bracket preferably comprises left and right sling and ball pinching arms. The rear arm 108 preferably further comprises sling and ball pinching means which are adapted for alternately moving arms 116 and 118 between a retracted sling and ball pinching and holding position as depicted in FIG. 4, and a splayed sling and ball releasing position as depicted in FIG. 2. Where the first "U" brackets rear arm 108 is configured to include, as preferred, sling and ball pinching means, such means preferably comprises a combination of a "C" channel 110, left and right pivot arms 112 and 114, and pivotal mounting means pivotally interconnecting the proximal ends of pivot arms 112 and 114 to the crossbeam 110. The preferred "C" channel configuration of the crossbeam 110 advantageously presents a clevis for pivoting receipts of the proximal ends of the left and right pivot arms 112 and 114. Where the sling and ball pinching means comprises pivot arms 112 and 114, as is preferred, the left and right sling and ball pinching arm components 116 and 118 of the first "U" bracket's rear arm 108 are preferably fixedly attached to the pivot arms' distal ends.

Referring further simultaneously to FIGS. 1, 2, and 4, means for normally biasing the pivot arms 112 and 114 to their splayed positions, or pivot arm biasing means, as depicted in FIG. 2 are preferably provided. Such biasing means preferably comprise extensions of the crossbeam 110 outwardly, leftwardly, and rightwardly from the pivotal mounts of the proximal ends of pivot arms 112 and 114. Such biasing means preferably further comprises springs 136 and 137 which respectively span between such left and right crossbeam extensions, and the left and right pivot arms 112 and 114.

Referring further simultaneously to FIGS. 1, 2, and 4, the preferred sling and ball pinching means component of the first "U" bracket's rear arm 108 preferably further comprises a trip bracket 124 which is preferably configured as a fourth "U" bracket having left and right downwardly extending arms 126 and 128. Upon engagement of the trip bracket 124 with the left and right pivot arms 112 and 114, as depicted in FIG. 4, the inner faces of arms 126 and 128 bias against the outer faces of pivot arms 112 and 114, such biasing contact resisting splaying motion which is normally impelled by springs 136 and 137. Upon alternate movement of the trip bracket 124 to its disengaged position as depicted in FIG. 2, pivot stopping contact between arms 126 and 128 and pivot arms 112 and 114 ceases, allowing springs 136 and 137 to swiftly splay the pivot arms 112 and 114, along with the sling and ball pinching arms 116 and 118, from their sling and ball pinching and retaining positions depicted in FIG. 4 to their sling and ball releasing position depicted in FIG. 2. Left and right hyper-extension stops 134 spanning across the clevis channel of the crossbeam 110 are preferably provided, such stops preventing hyper-extending splaying action of arms 112 and 114 from confounding springs 136 and 137.

Referring further simultaneously to FIGS. 1, 2, and 4, in order to conveniently guide alternate motions of the trip bracket 124 between its engaged and disengaged positions, a rocker arm 120 is preferably provided, the rocker arm 120 preferably having a rearward extending handle end and a forwardly extending trip end, the trip bracket 124 preferably being fixedly attached to the rocker arm's forwardly extending trip end. The rocker arm 120 is preferably pivotally mounted to the medial and rearward aspect of crossbeam 110 by means of a fixedly welded clevis 130 and by means of bolt 132 which spans laterally through the ears of clevis 130 and through rocker arm 120. Pivotal motion of the rocker arm 120 about bolt 132 effectively moves the rocker arm 120 between a first arm engaging position depicted in FIG. 4 and a second arm releasing position depicted in FIG. 2. The extreme rearward end of rocker arm 120 is preferably covered by a plastic end cap 122.

Referring further simultaneously to FIGS. 1, 2, and 4, the preferred sling and ball pinching means component of the first "U" bracket's rear arm 108 preferably further comprises rocker arm biasing means which are adapted for normally moving the rocker arm 120 to its first pivot arm's engaging and securing position, such biasing means preferably comprising a spring 138 which spans between the trip bracket 124 and an underlying anchoring point upon arm 108.

Referring to FIG. 1, in operation of the ball pitching machine 1, set screws 20 and 60 may be rotatably manipulated, and slide shafts 54 and 56 may be slidably moved for adjusting the trajectory of the machine 1 for batting practice pitching as depicted in FIG. 1. Alternately, referring further to FIG. 5, such set screws and slide shafts may be manipulated to facilitate pop fly fielding practice in the configuration depicted in FIG. 5. Set screws 102 and 104 may be similarly manipulated and the rearward segment 106 of the rocker beam 108 may be similarly longitudinally adjusted for selectively altering the pitching or throwing power of the machine. Upon accomplishing such machine set up steps, the machine may be placed at a convenient location within a baseball playing field, such as a pitcher's mound, and ground stakes (not depicted) may be driven through the stake receiving apertures at the lateral ends of feet 50, 8, 32, and 38. Prior to such stake driving, the machine 1 is preferably aimed as needed, toward, for example, a home plate strike zone, or toward a fly ball catch practice zone in the outfield.

Thereafter, referring simultaneously to FIGS. 1, 2, 5 and 6, pivot arms 112 and 114 may be drawn together from the splayed orientation depicted in FIG. 2 to the retracted orientation depicted in FIG. 6, at which orientation spring 138 biases trip bracket 124 to its first pivot arms engaging position. Thereafter, referring further to FIGS. 1 and 5, a baseball or softball 146 may be placed within the sling 144, and the sling and ball combination may thereafter be manually drawn rearwardly against elastomeric ties 140 and 142 until such combination overlies the upper ends of the sling and ball pinching arms 116 and 118. Thereafter, the sling 144 and ball 146 combination may be moved downwardly between such arms 116 and 118 to assume the configuration depicted in FIGS. 4 and 5. In such configuration, the sling 144 extends rearwardly from its left and right ends 141 and 143, thence further rearwardly from arms 116 and 118, and thence further rearwardly about the rear aspect of ball 146. In the configuration depicted in FIGS. 4 and 5, the sling pinching arms 116 and 118 tend to press or pinch inwardly upon the sling 144 to a point wherein the lateral displacement of arms 116 and 118 is less than the diameter of the ball 146. At such lateral arm displacement, the diameter of the ball mechanically stops forward passage of both the ball 146 and the sling 144 between arms 116 and 118.

Figure 3:
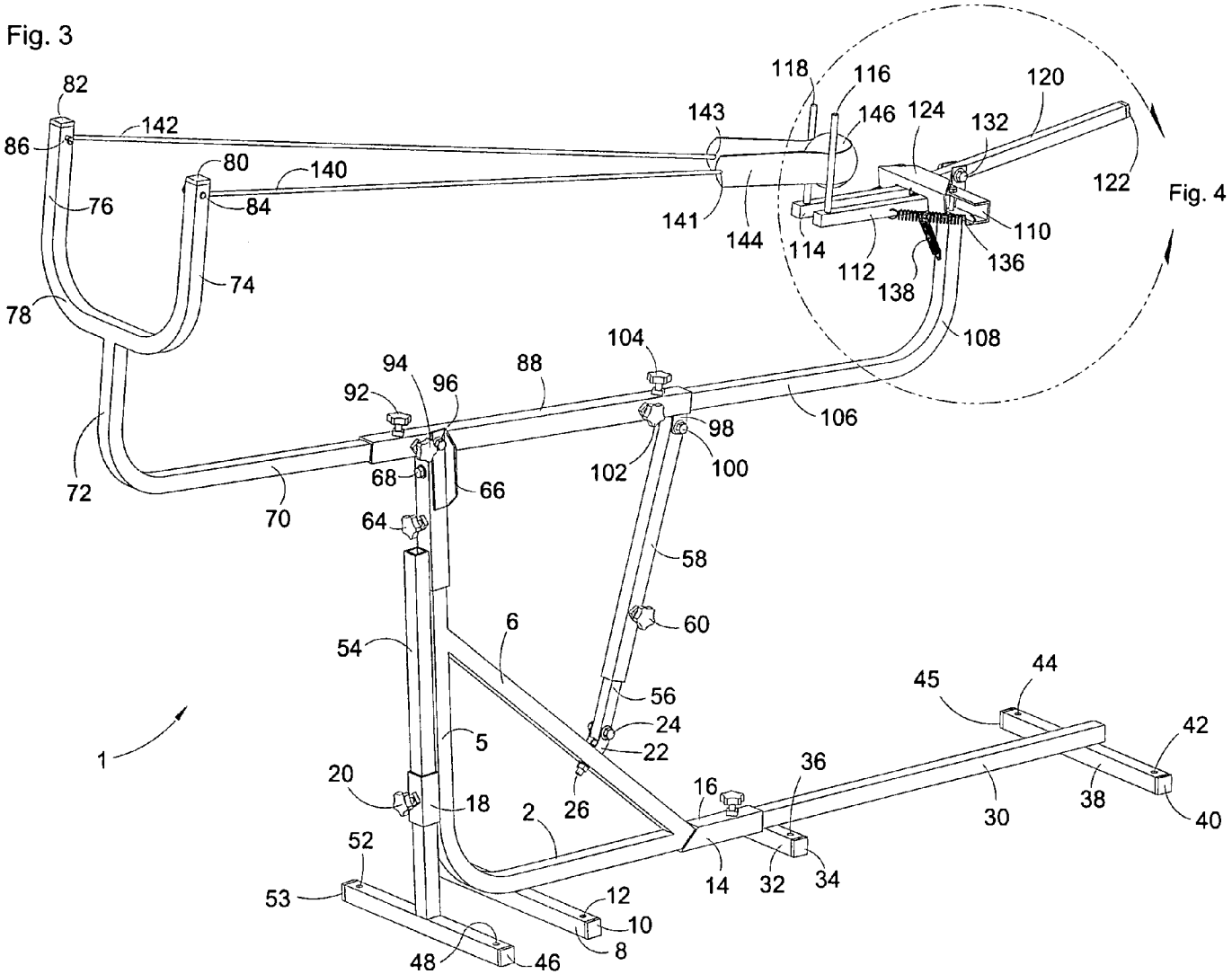
FIG. 3 redepicts FIG. 1, the view of FIG. 3 showing elastomeric ties stretched and extended, and showing a slinged ball ready to be pitched.

Referring simultaneously to FIGS. 3 and 4, upon configuration of the machine 1, as depicted, a user, typically a baseball coach, may conveniently grasp the rearwardly extending handle portion of rocker arm 120 and may depress downwardly thereon, moving the rocker 120 to its second position. Upon such motion, springs 136 and 137 swiftly splay both the pivot arms 112 and 114 and their attached sling and ball pinching arms 116 and 118, releasing the sling 144, and the ball 146 to be thrown forwardly between the arms 74 and 76 of the second "U" bracket in a manner similar to a sling shot action.

Repetition of the steps set forth above may advantageously repeatedly pitch the baseball 146, or numerous other baseballs, at substantially identical speeds and at substantially identical trajectories for facilitating batting and catching practice. Accurate repetitions of a selected ball trajectory and pitching speed is enhanced by, referring further to FIG. 4, springs 136 and 137 which serve to cleanly release the sling 144 and the ball 146, rather than allowing the pulling force of elastomeric ties 140 and 142 to pivotally drive apart the sling and ball pinching arms 116 and 118.

Referring simultaneously to FIGS. 1 and 5, it can be seen that in the configuration of FIG. 5, the baseball 146 has been positioned rightwardly within sling 144 prior to engagement of the sling 144 with the sling and ball pinching arms 116 and 118. Such rightward adjustment of the ball 146 within sling 144 beneficially results in additional stretching tension of tie 142 over and above that of tie 140. Accordingly, upon release of the sling 144 and the ball 146 from the configuration depicted in FIG. 5, the ties 140 and 142 advantageously tend to impose rotation upon the ball 146 as the ball travels along its trajectory, resulting in leftward ball curving motion. Alternately, the ball may be initially placed leftwardly within sling 144 for imposing rightward curving ball motion. The ball pitching machine's ability to repeatedly replicate such curving motions from ball spin in addition to replicating ball trajectory and speed constitutes an additional advantage and function of the instant invention.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

We claim:

1. A ball pitching machine comprising:

(a) a first "U" bracket having front and rear arms, the first "U" bracket further having a base spanning between the front and rear arms;

(b) a second "U" bracket having left and right arms, each left and right arm having a distal end, the first "U" bracket's front arm comprising the second "U" bracket;

(c) a third "U" bracket having left and right arms, the third "U" bracket comprising sling pinching means adapted for moving the third "U" bracket's left and right arms between retracted sling pinching positions and splayed sling releasing positions;

(d) left and right elastomeric ties, each having proximal and distal ends, the proximal ends of the left and right elastomeric ties being respectively fixedly attached to the distal ends of the second "U" bracket's left and right arms;

(e) a sling having left and right ends, the distal ends of the left and right elastomeric ties being respectively fixedly attached to the sling's left and rights ends; and (f) a carriage fixedly attached to the first "U" bracket; the carriage comprising trajectory adjusting means connected operatively to the first "U" bracket, the trajectory adjusting means being adapted for alternately moving the first "U" bracket's front and rear arms upwardly and downwardly with respect to each other.

2. The ball pitching machine of claim 1 wherein the operative connection of the trajectory adjusting means to the first "U" bracket comprises front and rear pivot mounts and at least a first telescoping shaft fixedly attached to and extending downwardly from a pivot mount selected from the group consisting of the front and rear pivot mounts.

3. The ball pitching machine of claim 2 further comprising a set screw, the set screw being alternately lockingly engagable with and releasingly disengagable from the at least first telescoping shaft.

4. A ball pitching machine comprising:

(a) a first "U" bracket having front and rear arms, the first "U" bracket further having a base spanning between the front and rear arms;

(b) a second "U" bracket having left and right arms, each left and right arm having a distal end, the first "U" bracket's front arm comprising the second "U" bracket;

(c) a third "U" bracket having left and right arms, the third "U" bracket comprising sling pinching means adapted for moving the third "U" bracket's left and right arms between retracted sling pinching positions and splayed sling releasing positions;

(d) left and right elastomeric ties, each having proximal and distal ends, the proximal ends of the left and right elastomeric ties being respectively fixedly attached to the distal ends of the second "U" bracket's left and right arms;

(e) a sling having left and right ends, the distal ends of the left and right elastomeric ties being respectively fixedly attached to the sling's left and rights ends; and (f) a carriage fixedly attached to the first "U" bracket; the carriage comprising a frame, a rear foot fixedly attached to the frame, a front foot, and telescoping means interconnecting the frame and the front foot, the telescoping means facilitating movement of the front foot between a downwardly extended trajectory elevating position and an upwardly retracted trajectory depressing position.

5. The ball pitching machine of claim 4 wherein the telescoping means comprises a slide shaft and slide sleeve combination.

6. The ball pitching machine of claim 5 further comprising a set screw extending through the slide sleeve of the slide shaft and slide sleeve combination, the set screw being alternately engagable with and disengagable from the slide shaft.

7. The ball pitching machine of claim 6 further comprising a plurality of ground stake apertures extending vertically through the front and rear feet.

8. A ball pitching machine comprising:

(a) an "L" frame comprising an upwardly extending support column having an upper end, and comprising a rearwardly extending base beam having a rear end;

(b) a rocker beam having front and rear ends, the rocker beam being mounted pivotally upon the upper end of the support column;

(c) pivot resisting means connected operatively to the rocker beam and to the "L" frame, the pivot resisting means being adapted for alternately permitting and resisting pivoting movement of the rocker beam with respect to the "L" frame;

(d) a sling shot having a sling, the sling shot being fixedly attached to the front end of the rocker beam;

(e) sling releasing means fixedly attached to the rear end of the rocker beam, the sling releasing means being adapted for alternately holding and releasing the sling.

9. The ball pitching machine of claim 8 wherein the rocker beam comprises forward and rearward segments, and further comprising telescoping means interconnecting the rocker beam's forward and rearward segments.

10. The ball pitching machine of claim 8 wherein the pivot resisting means comprises a telescoping shaft pivotally attached to and extending downwardly from the rocker beam.

11. The ball pitching machine of claim 8 further comprising a rear foot fixedly attached to the rear end of the rearwardly extending base, a front foot, and foot extending means interconnecting the front foot and the support column, the foot extending means being adapted for alternately downwardly extending and upwardly retracting the front foot.

12. The ball pitching machine of claim 8 wherein the sling releasing means comprises left and right arms and means for alternately holding the left and right arms in a sling pinching position, and releasing the left and right arms from the sling pinching means.

13. The ball pitching machine of claim 12 wherein the means for holding the left and right arms in their sling pinching positions comprises a spring biased rocker arm and trip bracket combination.

* * * * *